United States Patent [19]

Béla et al.

[11] 4,449,460

[45] May 22, 1984

[54] PROCESS AND APPARATUS, MAINLY FOR BURNING AGRICULTURAL PLANT REFUSE

[75] Inventors: Bátyi Béla; Gulyás Géza, both of Budapest; Bozsó Zoltán, Dunakeszi; Csákány István; Bartucz János, both of Budapest, all of Hungary

[73] Assignee: Láng Gépgyár, Budapest, Hungary

[21] Appl. No.: 358,811

[22] Filed: Mar. 16, 1982

[30] Foreign Application Priority Data

Mar. 17, 1981 [HU] Hungary ..... 670/81

[51] Int. Cl.[3] ..... F23B 5/00

[52] U.S. Cl. ..... 110/214; 110/225; 110/248; 110/251

[58] Field of Search ..... 110/210, 214, 224, 225, 110/235, 248, 251

[56] References Cited

U.S. PATENT DOCUMENTS

| | | | |
|---|---|---|---|
| 178,372 | 6/1876 | Kidder | 110/251 |
| 2,367,590 | 1/1945 | Lewens et al. | 110/248 |
| 4,334,484 | 6/1982 | Payne et al. | 110/214 |
| 4,341,199 | 7/1982 | Hand, Jr. et al. | 110/214 |
| 4,366,759 | 1/1983 | Foresto | 110/225 |

*Primary Examiner*—Henry C. Yuen

*Attorney, Agent, or Firm*—Karl F. Ross; Herbert Dubno

[57] ABSTRACT

Freshly harvested agricultural materials having a moisture content no greater than 45% by weight are burned in a furnace in which the housing thereof is divided into preburning and afterburning spaces by a baffle wall. The preburning space contains a horizontally arranged first grating adjacent the baffle wall and a second grating adjacent the first and inclined upwardly therefrom and juxtaposed with an inlet in the housing for the introduction at a constant rate of the materials onto the inclined grating, the upper portion of which is fed by a first portion of primary air for the removal of moisture from the materials, while a lower portion of the inclined grating is fed with a second portion of primary air for the air-deficient burning of the dried materials and the production of combustible gases. The horizontal grating is fed with a third portion of primary air for driving the combustible gases along the baffle wall, which acts to deflect the gases in a counterflow to the flow of the materials, the gases mixing with secondary air introduced through at least one air inlet formed in the baffle wall, the mixture being burned completely in the afterburning space.

4 Claims, 1 Drawing Figure

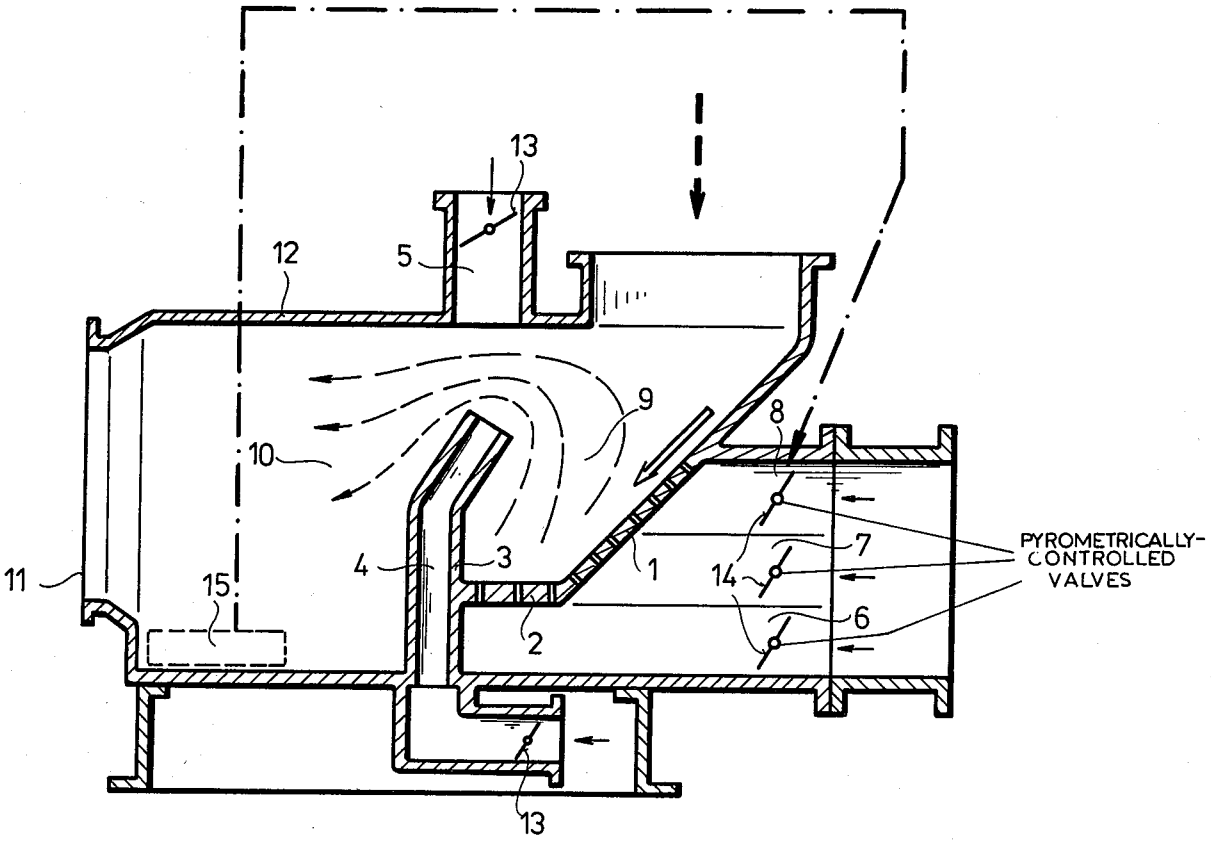
PYROMETRICALLY-CONTROLLED VALVES
1
2
3
4
5
6
7
8
9
10
11
12
13
13
14
15

PROCESS AND APPARATUS, MAINLY FOR BURNING AGRICULTURAL PLANT REFUSE

FIELD OF THE INVENTION

The invention relates to a process and apparatus for the utilization by burning of combustible materials, mainly agricultural plant refuse and, residues (refuse fuel), the moisture content (water) of which is not over 45 percent by weight.

BACKGROUND OF THE INVENTION

The burning of solids depends on heating the burnable materials the combustion point. Evaporation of the water content, i.e. the drying, depending on the moisture content of the burnable material, takes place simultaneously with the heating of the burnable material. Since the amount of heat necessary for evaporation of the water is higher than necessary for the combustion of the solids, the most critical phase of the process taking place in the furnace is the drying, especially in the case of burnable materials with high moisture content.

This problem appears mostly during the burning of agricultural plant refuse and, residues, namely they contain a large amount of moisture during harvesting.

These residues are characterized also by the fact that even in a normally air-dry condition, they contain a relatively large amount of moisture, consequently their utilization by burning represents an increased problem, while at the same time the residual products with high moisture content still existing from the harvesting soon begin to rot and become unsuitable for burning.

The furnaces still used for burning agricultural residues essentially apply the methods known for coal burning. The product fed from the hopper onto the grate is dried and brought to the burning point at the front part of the grate by conventional methods used for coal burning, with a socalled combustion crown, and with the reradiation effect of the flame developed in the burning phase. These methods are suitable for burning the air-dried agricultural residues only to a limited extent, since they are able to function only with burnable material of a maximum of 20–25% moisture content. One of the several reasons for this is that when burning agricultural residues, the temperature of the furnace chamber is significantly lower than in the case of coal burning, as a result of which the temperature of the combustion crown is also much lower. Since the heat flow transmitted by radiation is in proportion to the fourth power of the absolute temperature of the combustion crown, the traditional combustion crowns are not capable of drying burnable material containing large amounts of moisture.

For this reason burning most parts of the plant residue in freshly harvested condition, as for instance corn stalks, could not be realized.

OBJECT OF THE INVENTION

The present invention is directed toward elimination of the limits and shortcomings of the apparatuses already known and toward a burning process and furnace which are suitable for utilization by burning of agricultural residues having a higher moisture content than the already air-dried residues, but not in excess of 45% by weight.

SUMMARY OF THE INVENTION

The object of the burning process according to the invention is realized in two phases in such a way, that the burning in the first phase is incomplete (air-deficient burning) and the liberated combustion gas is conducted contrary to the main movement direction of the continuously fed burnable medium, where in the second phase the complete burning is ensured by blowing in secondary air.

The first phase ensures the drying of the burnable medium, while the second phase serves for heat utilization The furnace according to the invention is an apparatus for carrying out the mentioned burning process. Its essence is that the apparatus is divided into a preburning and afterburning sections which are seperated from each other by a baffle wall provided with air ducts directed towards the preburning space, the preburning space having a grate or gates assembled from stationary and partly mobile elements made up with at least one inclined and at least one horizontal section, and primary air ducts provided with control valves connected to the grates.

The purpose of blowing air through the grates is partly for drying and partly for incomplete burning. The baffle wall bending towards the preburning space deflects the combustion gases contrary to the flow direction of the burnable material. The air flowing from the secondary air ducts of the baffle wall serves for the complete burning of the combustion gases.

The process according to the invention is based on the recognition that the flames deflected contrary to the main flow direction of the continuously fed burnable material and the high-temperature combustion gases produce a highly intensive drying effect.

The process according to the invention is based also on the recognition that the steam liberated in the drying phase prevents further evaporation, since the air in the microclimate then absorbs less moisture, consequently the intensive drying is prevented by the liberated stem. The essence of the process is also represented by exchanging the steam-saturated air with constant fresh i.e. unsaturated air (its relative moisture content is less than 1%), or with the mixture of combustion gas and air, as a result of which the drying-retarding factor is considerably reduced, thus the intensity of evaporation is increased. At the same time the heat demand of drying is met by the heat of the burning medium.

In this way the excess moisture preventing burning is easily removed, i.e. the burnable materials with high moisture content of about 45 percent by weight can be burned up. The apparatus related to the burning process is divided into preburning and afterburning spaces separated by a baffle wall provided with air ducts bending and directed towards the preburning space, the preburning space having a mobile or stationary grate built up with at least one inclining and at least one horizontal or nearly horizontal section connected to the primary air ducts provided with control valves.

The burnable wet material moving down on the inclining grate section is blown through with fresh air from the bottom, whereby the intensity of drying is increased, while the baffle wall bending towards the preburning space deflects the combustion gases contrary to the flow direction of the burnable material moving downwards, and in this way the amount of heat necessary for evaporation is effectively ensured.

At the same time the air blown below the grates ensures the incomplete (air or oxygen-deficient) burning at the horizontal grate section.

The air flowing from the air ducts of the baffle wall ensures complete burning, whereby the heat of the burnable medium is fully liberated and utilized.

SPECIFIC DESCRIPTION

The apparatus is described by way of example in the sole FIGURE of the drawing. The diagrammatic FIGURE shows a longitudinal section view of the apparatus, where the feeding of the burnable wet medium is indicated with a thick dashed arrow, the path of the drying material with a continuous thick arrow, the path of the combustion gas of incomplete burning with thin dashed arrows, and the path of primary air with continuous thin arrows.

As shown in the diagram, the furnace chamber is divided into two parts: preburning space 9 and afterburning space 10. The hot combustion gases in the preburning space 9 derived from burning of the already dry material are conducted over the drying section in order to transfer the necessary amount of heat to the wet burnable material. Since the burning is incomplete in this part of the furnace chamber, the intake of secondary air is necessary, ensuring the complete burning in the afterburning space 10.

The furnace according to the invention has a zoned inclined grate 1 and a horizontal flat grate 2. The baffle wall 3 dividing the furnace chamber into two parts is arranged adjacent the flat grate. The intake of the secondary air is controlled with valves 13 and takes place partly through the duct 4 in the baffle wall and partly through the openings 5 arranged on the top of the furnace chamber.

Advantages according to the invention are the following:

The necessary amount of primary air is adjusted by valves 14 which are controlled pyrometrically or by other means and is fed from the air duct 6 through the horizontal grate 2 to the dry and well burned loose material (e.g. corn-stalk or corn-cob) accumulated at the bottom of the inclined grate. The rising hot gases flowing along the baffle wall 3 provides intensive heat transfer to the drying section, whereby the highly wet residual product on the inclined grate is dried and made suitable for burning.

The amount of primary air sufficient only for removal of water vapour is admitted through the air duct 8 of the drying section. The amount of primary air necessary only for air-deficient burning is admitted through the air duct 7 of the preburning section. The still combustible gases derived from this section properly mix with the secondary air flowing through ducts 4 and 5 at the relatively narrow gap between the baffle wall 3 and top of the furnace chamber 12. In this way, the complete burning of the gases in the afterburning space 10 is ensured.

For burnable materials with higher moisture content, the hot gas exhausted through the tapping opening 15 from the afterburning space 10 is mixed with the primary air flowing through the duct 8 connected to the drying section, whereby the drying becomes more intensive.

A further advantage of the apparatus is that although air-deficient burning takes place in the primary furnace chamber 9, which allows the effective operation of the drying phase, it does not result in the melting of the cinder. In this way, the flue gas carries off the flying ashes and prevents its deposition in the furnace chamber.

The invention is especially utilizable in agriculture, where normally the residues and refuses are mostly fibrous materials with an inhomogeneous structure spread on the grate and which does not let through the primary combustion air at a uniform rate, whereby the burning becomes uneven and open grate-parts occur in places, through which a large amount of unnecessary air passes into the furnace chamber, causing its cooling. This way of drying the admitted wet burnable material will not be satisfactory and the fire will become gradually extinct. However, if burnable material of low moisture content by drying is admitted at a uniform rate, and most of the air is discharged in the lower section of the inclined grate by zoned air control, then this phenomenon does not occur.

Utilization of the heat of the flue gases passing out of the afterburning space 10 through the connection 11 of the afterburner may take place in several ways. When a heat exchanger is connected to the furnace, depending on the type of the heat exchanger, hot air, warm or hot water, steam or their combination can be produced.

The process and apparatus according to the invention are used to advantage in agricultural farms, for they allow the production of thermal energy necessary for the farm from such refuse which occurs as a result of agricultural activity.

What we claim is:

1. An apparatus for burning agricultural materials having a moisture content no greater than 45% by weight comprising:

a housing;

a baffle wall formed in said housing and dividing same into preburning and afterburning spaces, said wall having an upper portion inclined toward said preburning space and being further formed with at least one secondary air inlet;

a first grating arranged horizontally in said preburning space adjacent said baffle wall;

a second grating arranged in said preburning space adjacent said first grating and inclined upwardly therefrom, said second grating being juxtaposed with an inlet for the introduction of said material in a constant flow;

a first air duct connected to an upper portion of said second grating for delivering a first portion of primary air thereto for the removal of moisture from said material;

a second air duct connected to a lower portion of said grate for delivering a second portion of primary air thereto for the air-deficient burning of the dried material and the production of combustible gases;

a third air duct connected to said first grate for delivering a third portion of primary air thereto for driving said combustible gases along said baffle wall for the deflection of said gases in a counterflow to the flow of said material, said gases mixing with secondary air introduced through said secondary air inlet for the complete burning of said mixture in said afterburning space to produce a hot gas; and an outlet in said afterburning space for the removal of said hot gas.

2. The apparatus defined in claim 1, further comprising respective pyrometrically controlled valves provided in said first, second and third air ducts.

3. The apparatus defined in claim 2, further comprising a second outlet provided in said afterburning space and connected to said first air duct.

4. The apparatus defined in claim 1, 2 or 3, further comprising a second secondary air inlet in juxtaposition with the first mentioned secondary air inlet and forming therewith a constriction between said preburning space and said afterburning space, said constriction acting as a mixing zone for said combustible gases and said secondary air.

* * * * *